United States Patent [19]

Yoshida

[11] 4,039,172

[45] Aug. 2, 1977

[54] OUTLET TROUGH FOR A MOLTEN PRODUCT

[75] Inventor: Tsuyoshi Yoshida, Bizen, Japan

[73] Assignee: Koa Taika Kogyo Kabushiki Kaisha, Japan

[21] Appl. No.: 730,016

[22] Filed: Oct. 6, 1976

[51] Int. Cl.[2] ..... C21B 7/14

[52] U.S. Cl. ..... 266/196; 266/281

[58] Field of Search ..... 266/195, 196, 230, 231, 266/236, 280, 281, 284, 286; 164/281, 337; 264/30; 222/590, 591

[56] References Cited

U.S. PATENT DOCUMENTS

| | | | |
|---|---|---|---|
| 636,885 | 11/1899 | Bachman | 266/231 |
| 1,210,091 | 12/1916 | McDonald | 266/231 |
| 3,174,739 | 3/1965 | Miller | 266/196 |
| 3,963,815 | 6/1976 | Ezaki et al. | 264/30 |

*Primary Examiner*—Gerald A. Dost

*Attorney, Agent, or Firm*—Eyre, Mann, Lucas & Just

[57] ABSTRACT

This invention provides an outlet trough for permitting withdrawal of molten products from a melting furnace, the body of said trough being a mass coaleaced under the influence of physical force, not under thermal influence, with the minimum of reinforcement, thereby making it possible to produce a large-scale outlet trough at reduced cost.

3 Claims, 6 Drawing Figures

FIG 1
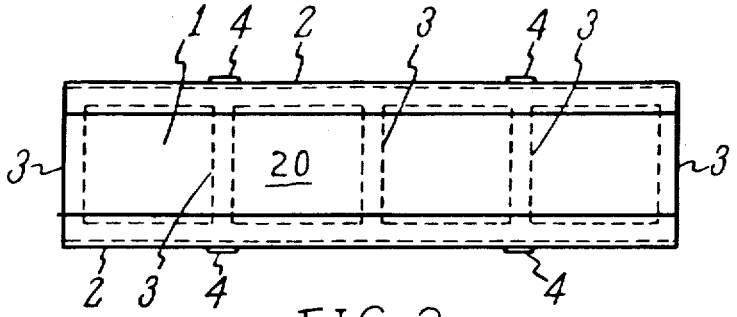
FIG 2
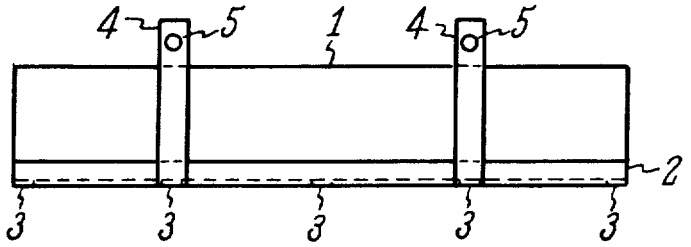
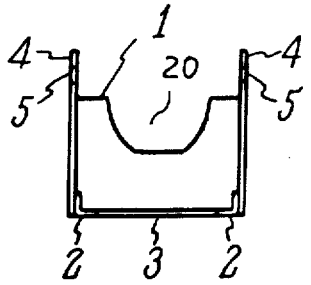
FIG 3

OUTLET TROUGH FOR A MOLTEN PRODUCT

This invention relates to a trough for use as an outlet channel permitting withdrawal of a molten product from a melting furnace, such as a blast furnace, an electric furnace. More particularly, the present invention relates to an outlet trough of large size for use as a channel from the furnace to a ladle, non-sintered and constructed as one piece without any joints or seams.

For constructing a large-scale outlet trough of a molten product, the known method is to employ a usual type of bricks, individually 200 to 600 mm long, which are laid in the form of a trough and jointed into one piece. But under this method a considerable amount of labor and cost is required in maintenance as well as in construction. For example, a continous watching service is needed to find a possible improper sean and/or brick, and regularly the trough per se must be replaced. Accordingly, in order to save the toil a proposal has been made for using individually large bricks, such as more than 600 to 3,000mm long. Neverthless it is not a perfect solution to the problem, and additionally, new problems have been encountered in employing a large brick. The major problem stems from the heavy weight and inconsistent internal structure of the trough, which requires that the whole body should be compacted by a robust reinforcement to maintain the dense aggregation. This has been embodied by covering the sides and bottom of the trough with iron plates. The addition of such reinforcement raises the production cost, and the advantages of reduced seams and saved labor has been traded off.

The present invention aims at solving the problems mentioned above, and has for its object to provide an improved trough for use as an outlet channel of molten products, coalesced under the influence of physical force, not under thermal influence, with a simple reinforcement, such as a small number of angles and bars, thereby making it possible to produce a large scale outlet trough at reduced costs.

The invention will be more particularly described by way of example with reference to the drawing, in which:

FIG. 1 is a plan view of a trough according to the present invention;

FIG. 2 is a side view of the trough in FIG. 1;

FIG. 3 is a front view of the trough in FIGS. 1 and 2;

Figure 4:
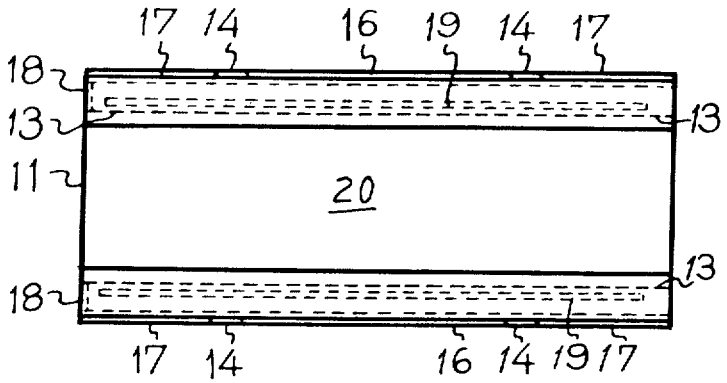
FIG. 4 is a plan view of a modified version of the trough in FIG. 1.

The trough illustrated in FIG. 1 is 2,000mm long, and the body 1 is a mass coalesced under the influence of a stamping force, with a simple reinforcement of angles 2 and flat bars 3. The angles 2 are laid so as to support the bottom corners of the body 1, and the flat bars 3 are laid to connect between the opposite angles, wherein each element is welded. At each side of the body 1 there are provided hook plates 4 with apertures 5 for permitting hoisting chains to pass through. The hook plates are welded to the angles 2. The angles can be additionally provided at the upper corners of the body 1. The distance between the adjacent flat bars 3 is preferably 400 to 600mm in this embodiment.

As described above, the body 1 is coalesced into a mass either by a stuffing method or a molding method. Under the stuffing method a disassemblable framework is employed, in which the reinforcing skeleton mentioned above is placed. With this inside the framework is uprightly erected and filled with a molding material containing a bonding substance. Then a stamping force is applied from the head. Alternatively, a suitable die is used to mold the body therein. After the body becomes solid the framework or the die is removed. When necessary, the hook plates are welded to the angles 2. The molding material is selected from those usable for conventional fire bricks.

Figure 5:
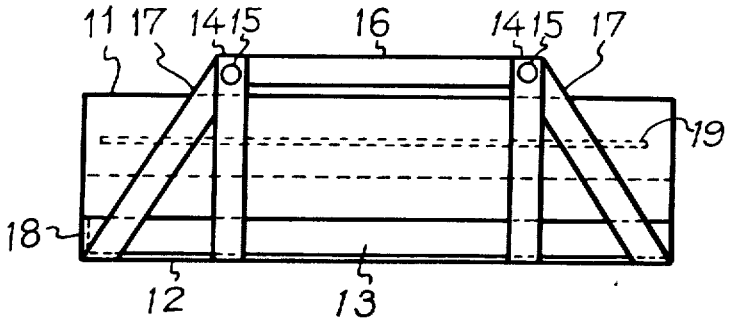
FIG. 5 is a side view of the trough in FIG. 4.
Figure 6:
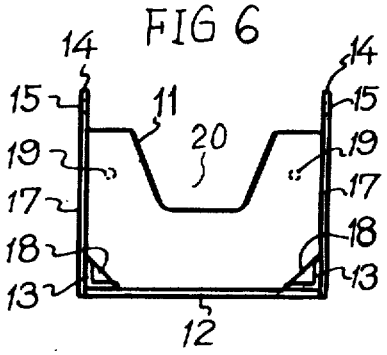
FIG. 6 is a front view of the trough in FIGS. 4 and 5.

The modified version illustrated in FIGS. 4 to 6 is provided with a plate of iron 12, instead of the flat bars 3 in the first embodiment. When a long trough is needed, such as more than 2,000mm long, and if the flat-bar supports are found insufficient to support the whole body, the body can be supported wholly by a metal plate. This is embodied as the modified version, but it is substantially the same as the first embodiment. The plate 12 is welded to the angles 13, and where necessary, auxiliary supports 16 and 17 are provided.

The plate 12 can be porous, and this is advantageous in shortening the time for the stuffed molding material to become solid by virtue of its exposure to be atmosphere. In this embodiment the trough can be safely as long as more than 3,000mm. Preferably, a further reinforcement bar can be embedded in the body 11. The illustrated embodiment is provided with two bars of such kind in parallel. The material is mild steel, of the type normally employed for a concrete building. It can be provided with denture on its periphery, so as to ensure its anchorage in the body 11, and its sectional shapes can be various, such as circular, rectangular, hexagonal. Alternatively, short bars, such as 200 to 300mm, can be connected to each other in the eccentric manner, so as to produce steps therebetween, which also are effective to enable them to anchor firmly in the body.

An outlet trough for a molten product is normally used in a titled position, extending from the furnace outlet up to the ladle. In order to prevent the body 1 and 11 from slipping off the reinforcing frame when the bond therebetween becomes loose, stops 18, as shown in FIG. 6, are provided at one end of the trough. In actual use the trough is tilted towards the ladle (not shown) such that the end with the stops 18 is faced to the ladle. The stops are welded to the angles 2 and 13.

Each of the body 1 and 11 has a long, narrow depression 20 in its top surface for permitting a molten liquid to flow. The sectional shape of the depression can be various, such as semi-circular, conical.

What is claimed is:

1. An outlet trough for a molten product, which comprises a body having a long, narrow depression in the top surface thereof permitting said molten product to run through, said body being supported by angle bars at the bottom corners thereof, said angle bars at opposite bottom corners being connected by flat bars provided at intervals, said body being a mass coalesced under the influence of physical force.

2. An outlet trough as claimed in claim 1, wherein the angle bars are provided with hook plates with apertures.

3. An outlet trough as claimed in claim 1, wherein the angle bars are provided with stopping means at one end thereof, so as to prevent the body from slipping off when the trough is tilted.

* * * * *